US012433363B2

(12) United States Patent
Losos et al.

(10) Patent No.: US 12,433,363 B2
(45) Date of Patent: Oct. 7, 2025

(54) SYSTEMS AND METHODS FOR RELEASABLY CONNECTING A HELMET LINER AND HEADBAND ASSEMBLY

(71) Applicant: MSA Technology, LLC, Cranberry Township, PA (US)

(72) Inventors: David J. Losos, Portersville, PA (US); Maxwell R. Naar, Doylestown, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 235 days.

(21) Appl. No.: 17/876,673

(22) Filed: Jul. 29, 2022

(65) Prior Publication Data

US 2024/0032640 A1 Feb. 1, 2024

(51) Int. Cl.
*A42B 3/14* (2006.01)
*A42B 3/32* (2006.01)

(52) U.S. Cl.
CPC ..... *A42B 3/145* (2013.01); *A42B 3/324* (2013.01)

(58) Field of Classification Search
CPC ..... A42B 3/10; A42B 3/145; A42B 3/324
See application file for complete search history.

(56) References Cited

U.S. PATENT DOCUMENTS 2,415,214 A * 2/1947 Lewis ..... A42B 3/14 2/419
3,613,114 A 10/1971 Hill et al.
3,758,889 A * 9/1973 Erb ..... A42B 3/145 2/416
4,051,555 A 10/1977 Daly
9,307,802 B2 * 4/2016 Hall ..... A42B 3/145
9,801,424 B2 * 10/2017 Mazzarolo ..... A42B 3/12
11,583,024 B2 * 2/2023 Rietdyk ..... A42B 3/145
2004/0093660 A1 5/2004 Bostock
2006/0206994 A1 9/2006 Rogers et al.
2009/0222978 A1 * 9/2009 Fang ..... A42B 3/145 2/421
2018/0092424 A1 * 4/2018 Hall ..... A42B 3/142
2019/0380418 A1 * 12/2019 Musal ..... A42B 3/08
2021/0076769 A1 3/2021 Kirshon

OTHER PUBLICATIONS

Patent Cooperation Treaty, International Search Report and Written Opinion of the International Searching Authority, PCT/US2022/038793, dated Nov. 1, 2022.

* cited by examiner

*Primary Examiner* — Katherine M Moran
(74) *Attorney, Agent, or Firm* — Jones Day

(57) ABSTRACT

Systems and methods are provided for a helmet having a configurable headband assembly. A helmet includes a helmet liner having a plurality of headband attachment points, each headband attachment point including a first opening for receiving and holding a primary attachment structure; and a second opening for receiving a locking pin. A headband assembly is configured to assist in fitting the helmet to a wearer's head. The headband assembly includes a fit adjustment mechanism configured to adjust an internal shape of the headband assembly; and a plurality of attachment structure sets, an attachment structure set including a primary attachment structure; and a locking pin.

18 Claims, 16 Drawing Sheets

SYSTEMS AND METHODS FOR RELEASABLY CONNECTING A HELMET LINER AND HEADBAND ASSEMBLY

BACKGROUND

Helmets are a common form of protective gear for the head, protecting the human brain. Helmets have a wide range of applications ranging from recreational, to construction, to combat, to safety and rescue (e.g., full brimmed fire helmets). Helmets are often constructed in portions, where a helmet liner (e.g., one or more components inside of an outer shell, sometimes referred to as an inner liner assembly) interfaces with a wearer's head and provides some level of protection, such as via padding applied to the outside of the inner portion to provide shock absorption. An outer shell, often having a hard outward facing surface provides additional protection, such as providing further shock absorption as well as helmet penetration prevention.

Proper fitting of a helmet is critical to its effective use. A helmet with an improper fit may not function well, particularly in critical moments. For example, an improperly situated helmet could dislodge from a wearer's head, a loose helmet could shift such that the helmet or accessories thereon obstruct the wearer's sight, or an ill-fitting helmet can be a distraction to a user. All of these occurrences could result in injury. An sub-optimally sized helmet may also cause general discomfort and fatigue for a wearer.

SUMMARY

Systems and methods are provided for a helmet having a configurable headband assembly. A helmet includes a helmet liner having a plurality of headband attachment points, each headband attachment point including a first opening for receiving and holding a primary attachment structure; and a second opening for receiving a locking pin. A headband assembly is configured to assist in fitting the helmet to a wearer's head. The headband assembly includes a fit adjustment mechanism configured to adjust an internal shape of the headband assembly; and a plurality of attachment structure sets, an attachment structure set including a primary attachment structure; and a locking pin.

In another example, a method of adjusting a helmet includes receiving a helmet comprising: a helmet liner having a plurality of headband attachment points, each headband attachment point comprising a first opening for receiving and holding a primary attachment structure and a second opening for receiving a locking pin; and a headband assembly comprising an attachment structure set comprising a primary attachment structure and a locking pin. A position of the helmet liner is adjusted relative to the headband assembly by moving the attachment structure set from a first headband attachment point to a second headband attachment point of the plurality of headband attachment points.

DETAILED DESCRIPTION

Multi-layer helmets may ease in the manufacturing of helmets, where a hard outer shell can be manufactured separately from an inner helmet liner that may optimally be made from wholly different materials and be subjected to disparate manufacturing processes. For example, the inner helmet liner may be fabricated using materials and features designed to provide a snug and comfortable fit on the interior, while having a shock absorbing material (e.g., Styrofoam, air bladders, vinyl nitryl foam, expanded polypropylene foam) applied to the outer surface of the inner helmet liner. The outer helmet shell may then be made of a rigid or penetration preventative material, such as Kevlar, carbon fiber, polycarbonate, molded plastics, composite materials, or combinations thereof.

While a multi-layer implementation provides certain advantages, ensuring a proper fit of such helmets is often a difficult task. This is in part because of different head sizes and shapes of wearers as well as comfort and other preferences of those wearers. Fit customization may be provided through one or more of adjustable straps and bands. It is important that such customization can be performed in a time-efficient manner. Additionally, in some instances, it may be desirable for such customizations to be repeatable across different pieces of equipment that a single wearer might use (e.g., a fire helmet for use in fire rescue exercises, a hard had for non-fire search and rescue missions).

Systems and methods as described herein provide a helmet having an adjustable headband assembly. In embodiments, a helmet includes a helmet liner having a plurality of headband attachment points that comprise a first opening for receiving and holding a primary attachment structure and a second opening for receiving a locking pin of a headband assembly. The attachment points provide mechanisms for fast, efficient adjustment of the fit of a helmet, promoting a secure, safe, comfortable fit.

Figure 1:
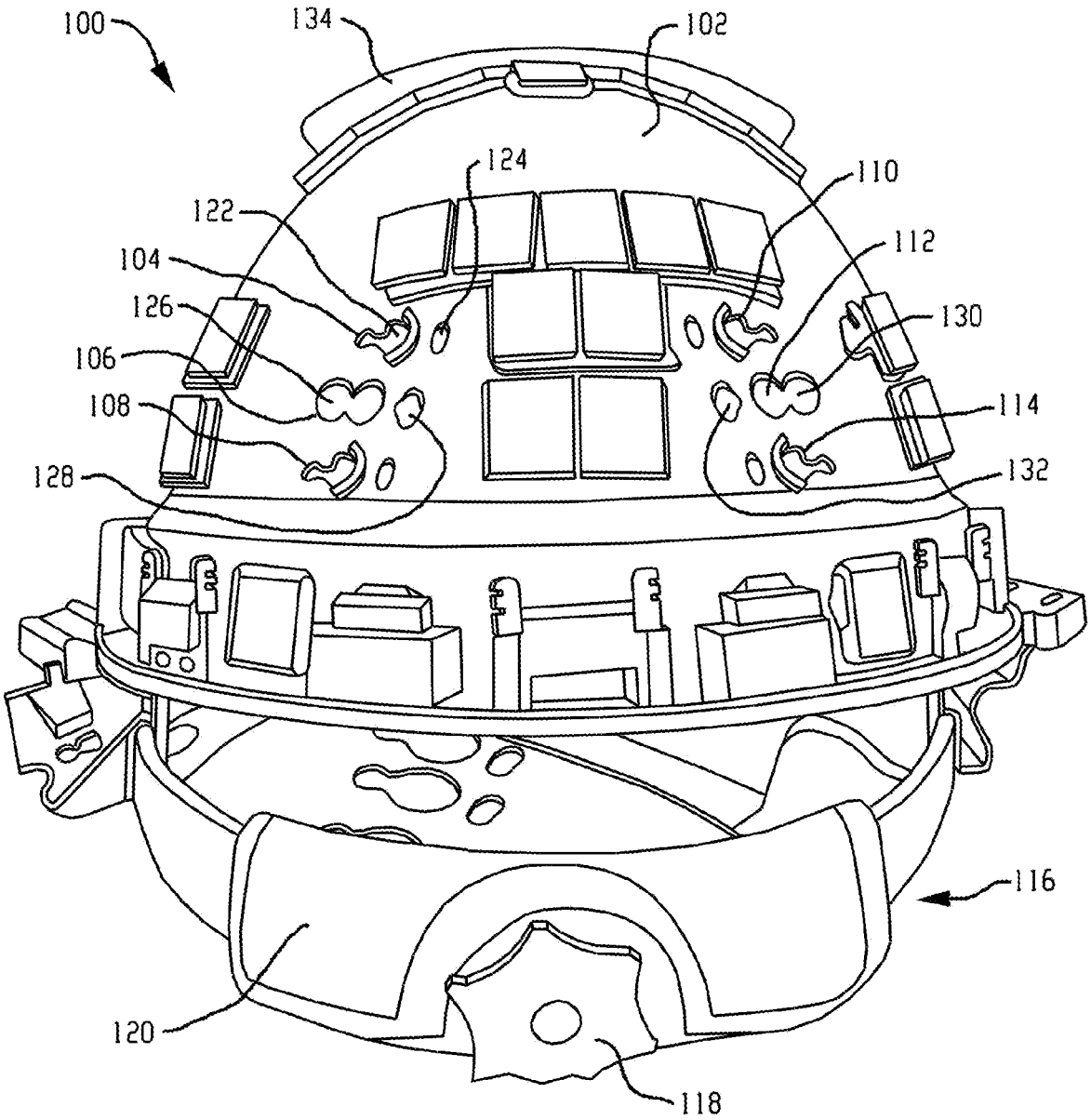
FIG. 1 is a diagram depicting a rear view of a helmet liner having a configurable headband assembly.

FIG. 1 is a diagram depicting a rear view of a helmet having a configurable headband assembly. The helmet 100 includes a helmet liner 102, which may take the form of a hardened material such as molded or 3-D printed plastic or some other rigid material. The helmet liner 102 includes a plurality of headband attachment points 104, 106, 108, 110, 112, 114, where six headband attachment points are depicted in FIG. 1. The helmet also includes a headband assembly 116 that is configured to assist in fitting the helmet 100 to a wearer's head (e.g., by augmenting an internal shape of the headband assembly 116 within the helmet). The headband assembly 116 includes a fit adjustment mechanism 118 that is configured to adjust the internal shape of the headband assembly 116. In the example of FIG. 1, the fit adjustment mechanism 118 includes a turnable knob configured to ratchet certain plastic bands of the headband assembly 116 so as to make the internal shape of the headband assembly 116 larger or smaller. The headband assembly 116 includes a soft-padded portion at 120 that is configured to interface with a nape of a neck of a wearer, so as to secure positioning of the helmet 100 on the head of the wearer.

In embodiments, the headband attachment points are arranged in pairs, where the headband assembly 116 is configured to be attached to one (e.g., exactly one) of the pairs at a time. (In embodiments, the headband attachment points may be arranged in trios or other sized groupings.) The example of FIG. 1 includes three pairs of headband attachment points, a top pair 104, 110; a middle pair 106, 112; and a bottom pair 108, 114. By attaching the headband assembly 116 to one of those three pairs of headband attachment points, the relative position of the helmet liner 102 relative to the nape of a wearers neck may be raised or lowered. In the example of FIG. 1, the headband assembly is connected to the middle pair 106, 112 of headband attachment points.

Each of the headband attachment points of FIG. 1 includes two openings. The first opening 122 of the first headband attachment point 104 may be a larger opening than the second opening 124 (as depicted in FIG. 1), the first opening being configured for holding a primary attachment structure of the headband assembly 116. In the example of FIG. 1, the first opening 122 takes the shape of two overlapping circles of different sizes, sometimes referred to as a snowman shape. One rim of the larger circle has a raised ridge for guiding the primary attachment structure. The first headband attachment point 104 further includes the second opening 124 that takes the form of a slit or slot for receiving a locking pin of the headband assembly 116.

In the example of FIG. 1, the headband assembly 116 includes two attachment structure sets 126, 128; 130, 132, each of which includes a primary attachment structure 126, 130 and a locking pin 128, 132. The two attachment structure sets are connected to the second pair of headband attachment points 106, 112 of the helmet liner 102. The first attachment structure set (comprising primary attachment structure 126 and locking pin 128) is connected to the helmet liner 102 via headband attachment point 106. Specifically, the primary attachment structure 126 of the first attachment structure set is shown held within the first opening of headband attachment point 106, while the locking pin 128 is positioned within the slot of the second opening of headband attachment point 106. In one example, this connection is achieved by first sliding the top of the primary attachment structure 126 into the larger circumference portion of the first opening that is large enough for the primary attachment structure 126 to pass. The primary attachment structure 126 is then shifted or slid (to the left in FIG. 1) such that its top is above the smaller circumference portion of the first opening that is smaller than and does not allow passage of the top of the primary attachment structure 126 therethrough. In that position, the thinner base of the primary attachment structure that bridges the top of the primary attachment structure to the rest of the headband assembly is retained within the smaller circumference portion of the first opening of headband attachment point 106. When in this position, the locking pin 128 of the first attachment structure set is positioned within the second opening of the headband attachment point 106. To remove the first attachment structure set (comprising primary attachment structure 126 and locking pin 128) from headband attachment point 106, the locking pin 128 may first be removed from the second opening, which may then permit the primary attachment structure 126 to be slid from the smaller circumference portion of the first opening to the larger circumference portion (e.g., hitting the raised rail on the right edge to prevent overshooting), where the primary attachment structure 126 can then be pulled through the larger circumference portion. Similarly, the second attachment structure set (comprising primary attachment structure 130 and locking pin 132) is positioned within headband attachment point 112. There, the primary attachment structure 130 is positioned in the first opening, while the locking pin 132 is positioned within the second opening slot. In the embodiment of FIG. 1, the second openings of the headband attachment points are slots, rather than round openings. The slot shape is configured to allow movement of each locking pin within its slot, which allows some rotation of the primary attachment structure during movement of the locking pin within the slot (where that rotation is limited by the length of the slot). This arrangement provides some limited play of the liner 102 relative to the headband assembly 116, which may aid in assembly and in some instances may provide an enhanced safety effect (e.g., mitigate undesired helmet dislodging).

Figure 2:
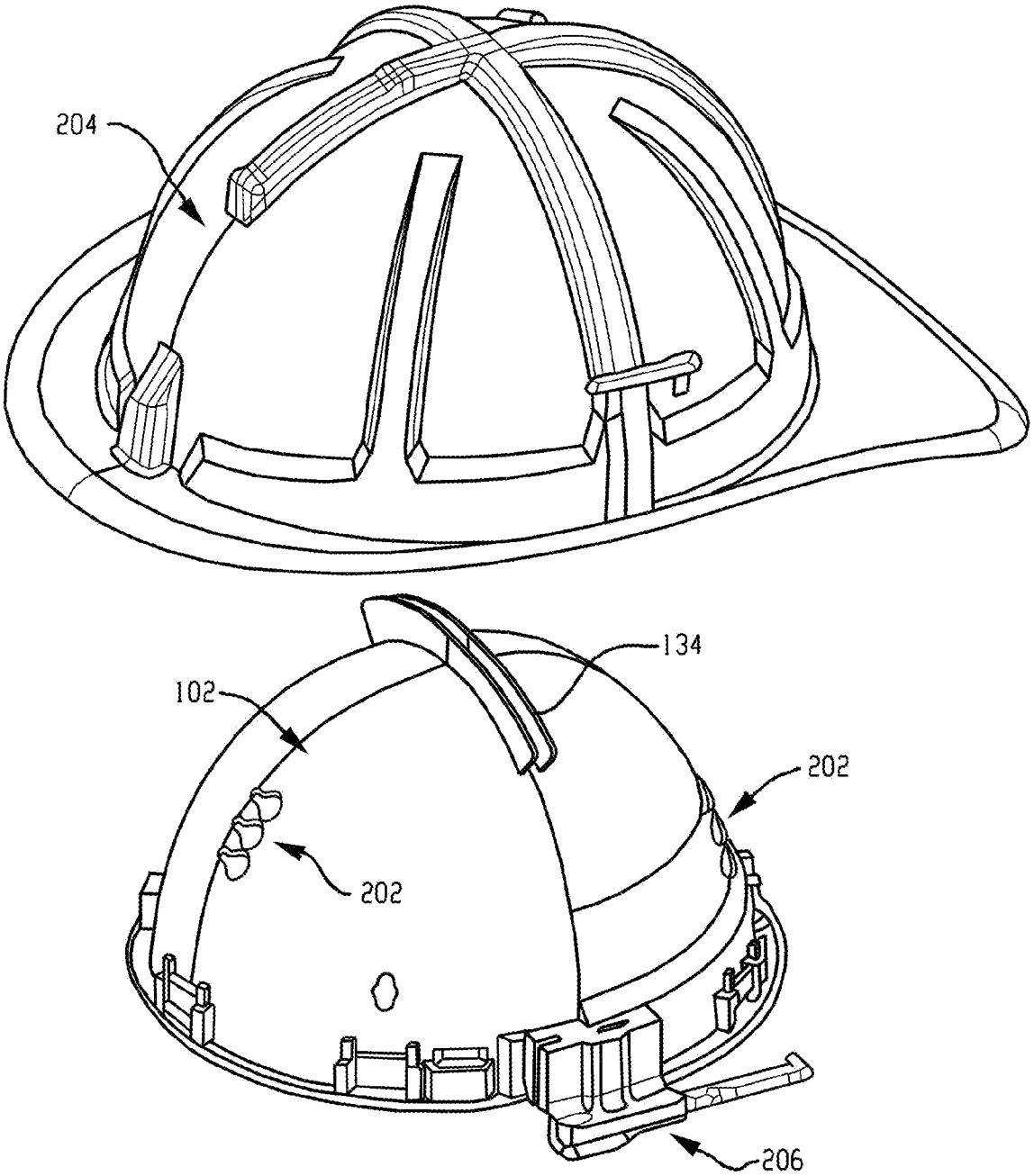
FIG. 2 is a diagram depicting an exploded view of a full brimmed fire helmet and helmet liner.

FIG. 1 further includes a ridge 134 at the top of the helmet liner 102 for supporting an outer structure (e.g., a hard outer shell) that is attached to the helmet liner 102. As noted above, a helmet having a configurable headband assembly as described herein can take a number of forms. FIG. 2 is a diagram depicting an exploded view of a full brimmed fire helmet and helmet liner. The helmet includes a helmet liner 102 having certain headband attachment points 202 thereon. The helmet includes an outer shell 204 that is configured to be attached to the helmet liner 102, such as via a sliding lock mechanism 206 once set into position. When attached, the outer shell 204 covers the plurality of headband attachment points 202. In the embodiment of FIG. 2, the outer shell takes the form of a full brimmed fire helmet. Other outer shells may include no brim, a small lip, or small brim (e.g., a baseball hat) arrangement.

Figure 3:
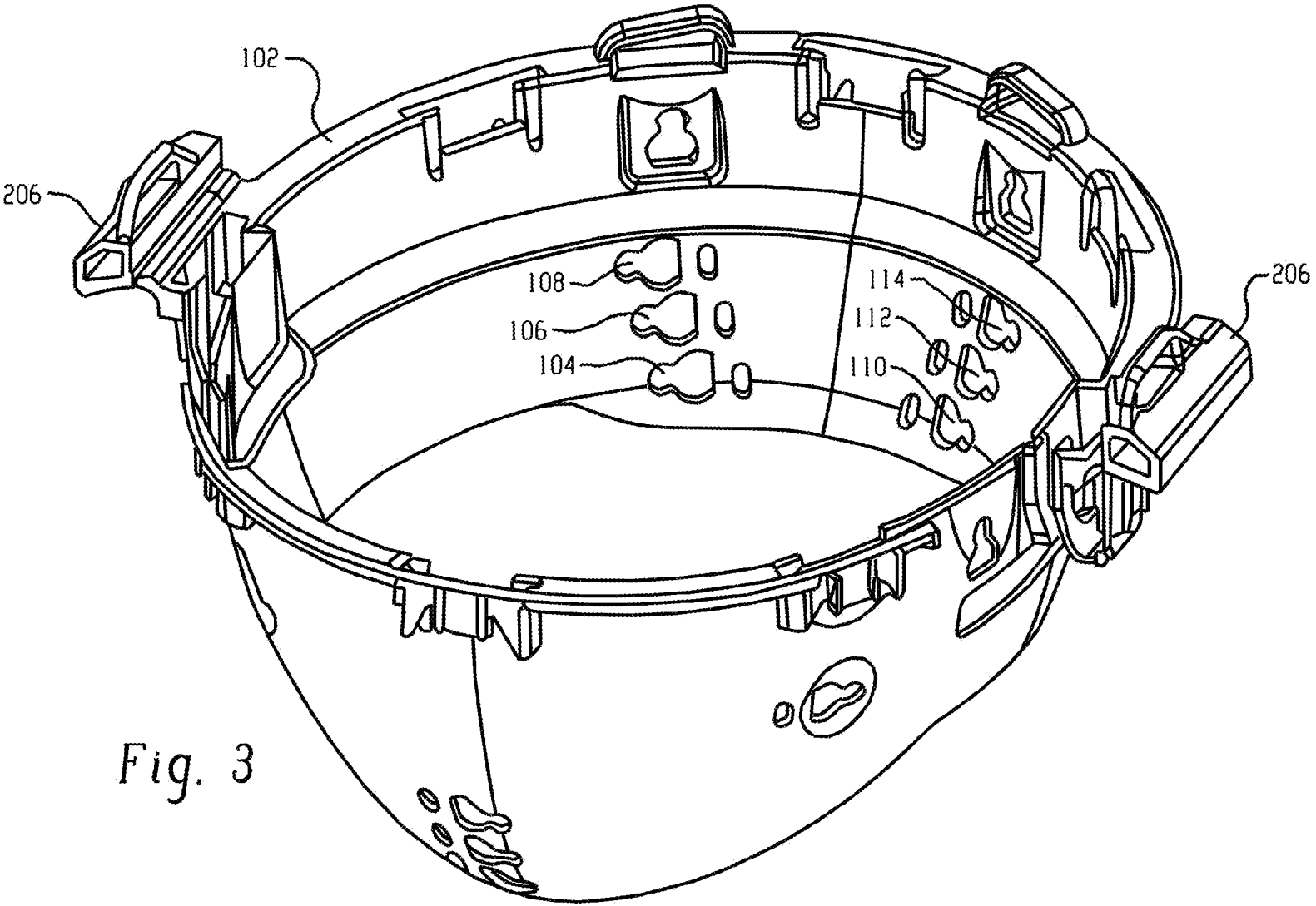
FIG. 3 is a diagram depicting an inside view of an example helmet liner.

FIG. 3 is a diagram depicting an inside view of an example helmet liner. The helmet liner 102 includes a plurality of headband attachment points 104, 106, 108, 110, 112, 114, each headband attachment point comprising a first opening for receiving and holding a primary attachment structure and a second opening for receiving an attachment pin. The helmet liner 102 further includes receptacles 206 for receiving a pin to form a sliding lock for attaching an outer shell to the helmet liner 102.

Figure 4:
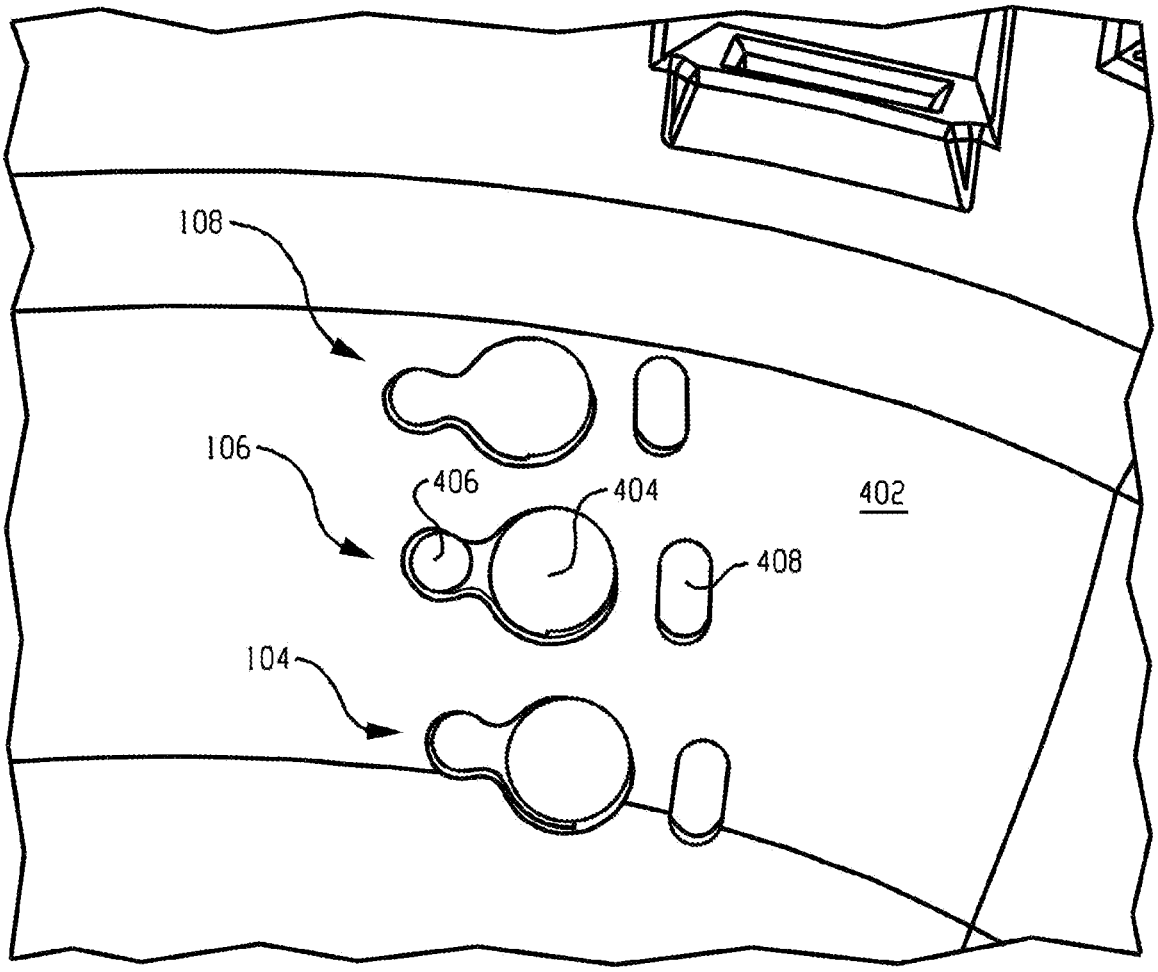
FIG. 4 provides an enhanced view of three of the headband attachment points.

FIG. 4 provides an enhanced view of three of the headband attachment points 104, 106, 108 on the helmet liner 402. Each of the three headband attachment points 104, 106, 108 includes a first, larger opening for receiving and holding a primary attachment structure, and a second opening for receiving a locking pin. With further reference point to the middle attachment point 106, the first opening-402 comprises a first portion 404 that is large enough for passage of the top of the primary attachment structure of a headband assembly and a second portion 406 that is smaller than the top of the primary attachment structure but larger than the base of the primary attachment structure (e.g., of a primary attachment structure that is shaped like a nail head). In the example of FIG. 4, the first portion 404 and the second portion 406 comprise non-overlapping circular portions. In other examples, first portion 404 and second portion 406 are formed by overlapping circles. The first portion 404 is configured to allow shifting of the primary attachment structure from the first portion to the second portion.

The middle headband attachment point 106 further includes a second opening 408 for receiving a locking pin of the headband assembly. In the example of FIG. 4, the second opening 408 is formed as a slit or a slot that allows some movement of the locking pin within the second opening. In other embodiments, the second opening is of a circular shape that allows more limited or no movement of the locking pin when retained in the second opening.

Figure 5:
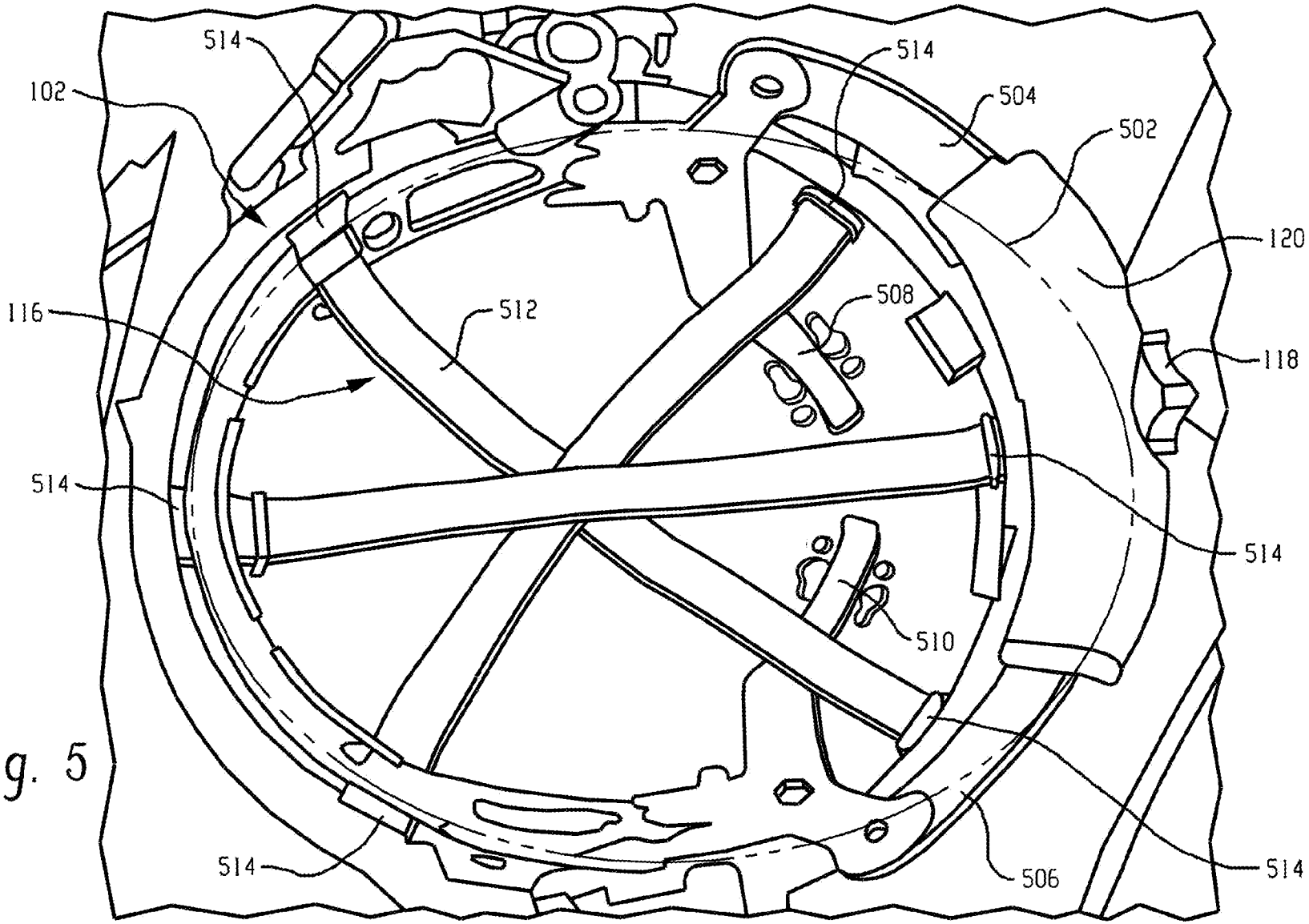
FIG. 5 is a diagram depicting a headband assembly installed within the interior of a helmet liner.

FIG. 5 is a diagram depicting a headband assembly installed within the interior of a helmet liner. The headband assembly 116 in the example of FIG. 5 includes a plurality of semi-rigid plastic (e.g., molded, 3-D printed) members connected to one another. The headband assembly 116 includes a fit adjustment mechanism 118 that is configured to adjust an internal shape of a lower circuit 502 of the headband assembly. In FIG. 5, the fit adjustment mechanism 118 includes a turnable knob that is configured to ratchet sub-portions 504, 506 closer or further from one another to adjust the lower circuit 502 of the headband assembly 116 to be of a larger or smaller size, where soft-padded portion 120, at the intersection of portions 504, 506 is configured to interface with a nape of a neck of a wearer. In addition to the sub-portions of the headband assembly that form the lower circuit 502, the headband assembly 116 further includes one or more (e.g., 2 or more) branches 508, 510 extending from the lower circuit 502 for interfacing the headband assembly 116 with the helmet liner 102. The branches 508, 510 each include an individual attachment structure set (e.g., a primary attachment structure and a locking pin) for interfacing with headband attachment points of the helmet liner 102. In FIG. 5, the attachment structure sets are not visible as they are on the reverse side of branches 508, 510. In the example of FIG. 5, the branches 508, 510 are connected to respective left and right middle headband attachment points of three sets of headband attachment points provided on the helmet liner. FIG. 5 further depicts a suspension web 512. The suspension web 512 of FIG. 5 comprises a plurality of straps for supporting, in part, the helmet liner 102 on the wearer's head. The suspension web 512 may be configured to provide a fit of the helmet liner 102 on the top of the wearer's head, where in combination with the lower circuit 502 of the headband assembly provides a secure fit of a helmet to a wearer's head. In the embodiment of FIG. 5, the suspension web 512 is secured to the helmet liner 102 via six suspension attachment points 514, where clips connected to the six straps (e.g., three longer straps sewn together at a central point) are inserted into the suspension attachment points 514.

Figure 6:
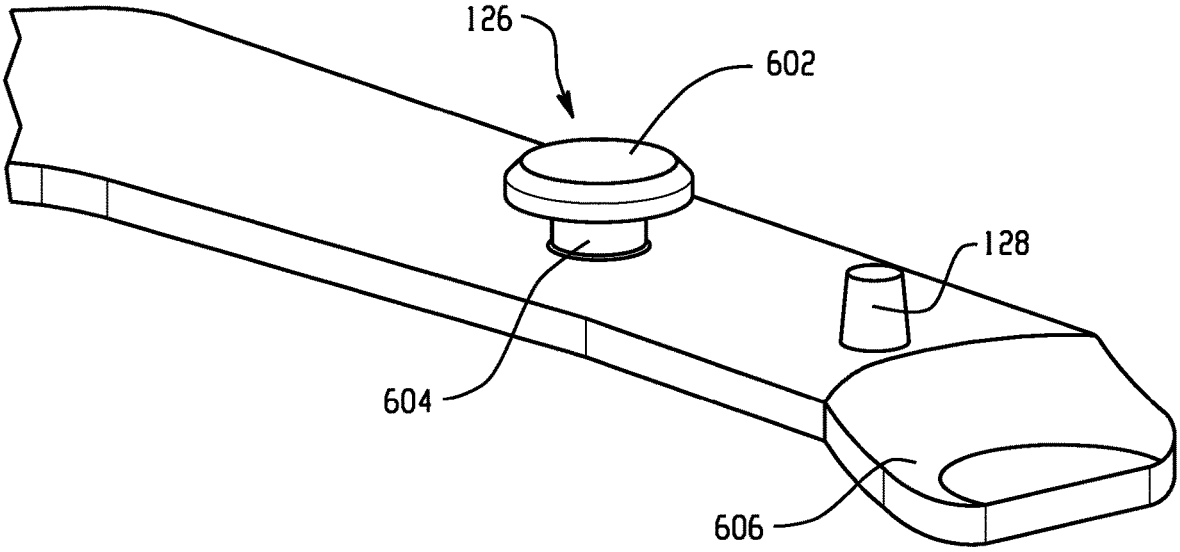
FIG. 6 is a diagram depicting an example attachment structure set of a headband assembly.
Figure 7:
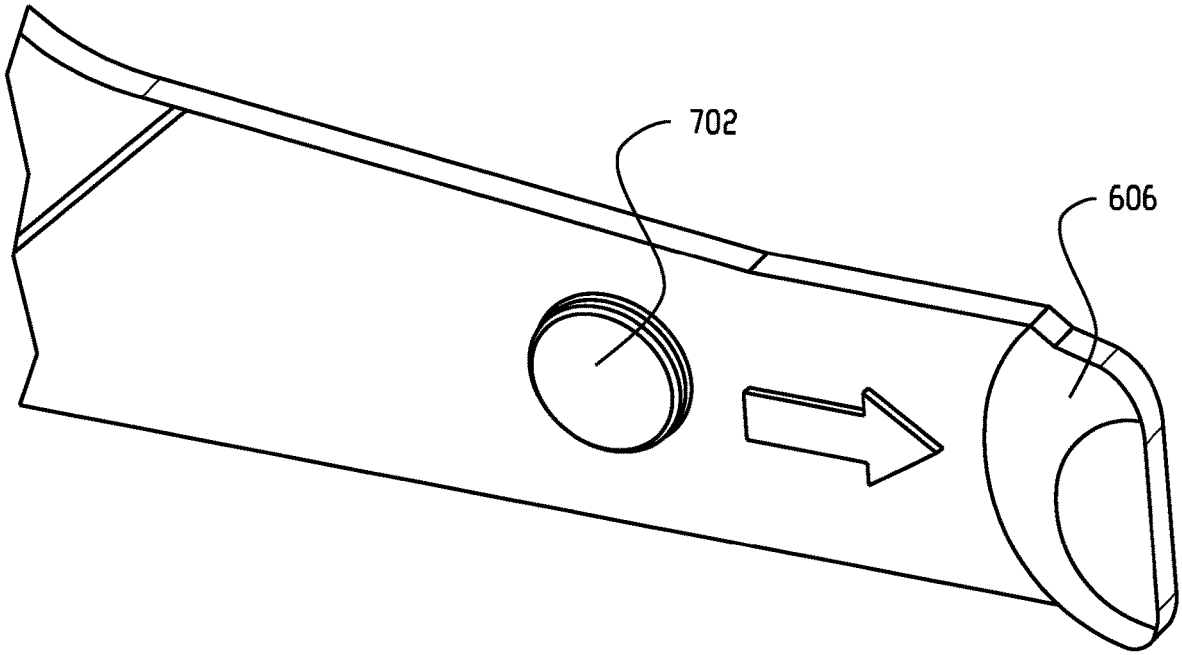
FIG. 7 is a diagram depicting a reverse side of an attachment structure.

FIG. 6 is a diagram depicting an example attachment structure set of a headband assembly. Each branch (e.g., 508, 510) of the headband assembly includes a primary attachment structure 126 and a locking pin 128. The primary attachment structure may take a variety of forms including the nail-head format depicted in FIG. 6. The primary attachment structure 126 includes a top portion 602 and a base portion 604. The top portion 602 is wider than the base portion 604. As described above, the first opening of a headband attachment point may include a first portion that is larger than the top 602 of the primary attachment structure, while a second portion is smaller than the top 602 but is larger than the base 604, such that the first opening is configured to allow shifting of the primary attachment structure 126 from the first portion to the second portion for retention, in combination with insertion of the locking pin 128 into the second opening of the headband attachment point. The branch may include a tab 606 that is configured to aid a user in sliding the primary attachment 126 portion into a correct portion of a first opening and for inserting the locking pin 128 into a second opening FIG. 7 is a diagram depicting a reverse side of an attachment structure. One or more of the branches (e.g., 508, 510) of the headband assembly may include a structure 702. That structure 702 may be configured to provide finger-traction for assisting with installation of the attachment structure. Tab 606 provides a grip point for assisting with installation and removal of the branch from an inner liner. In one embodiment, the structure 702 may be configured to hold a helmet accessory. The example of FIG. 7 provides the structure 702 as one side of a snap. The structure 702 may be configured for positioning toward an interior of the helmet liner and may be configured to hold, alone or in combination with other structures, a helmet accessory. Helmet accessories may take a wide variety of forms including a radio, a face shield, an ear protection device, a badge, a light, a sensor, padding, or a location beacon.

Figure 8:
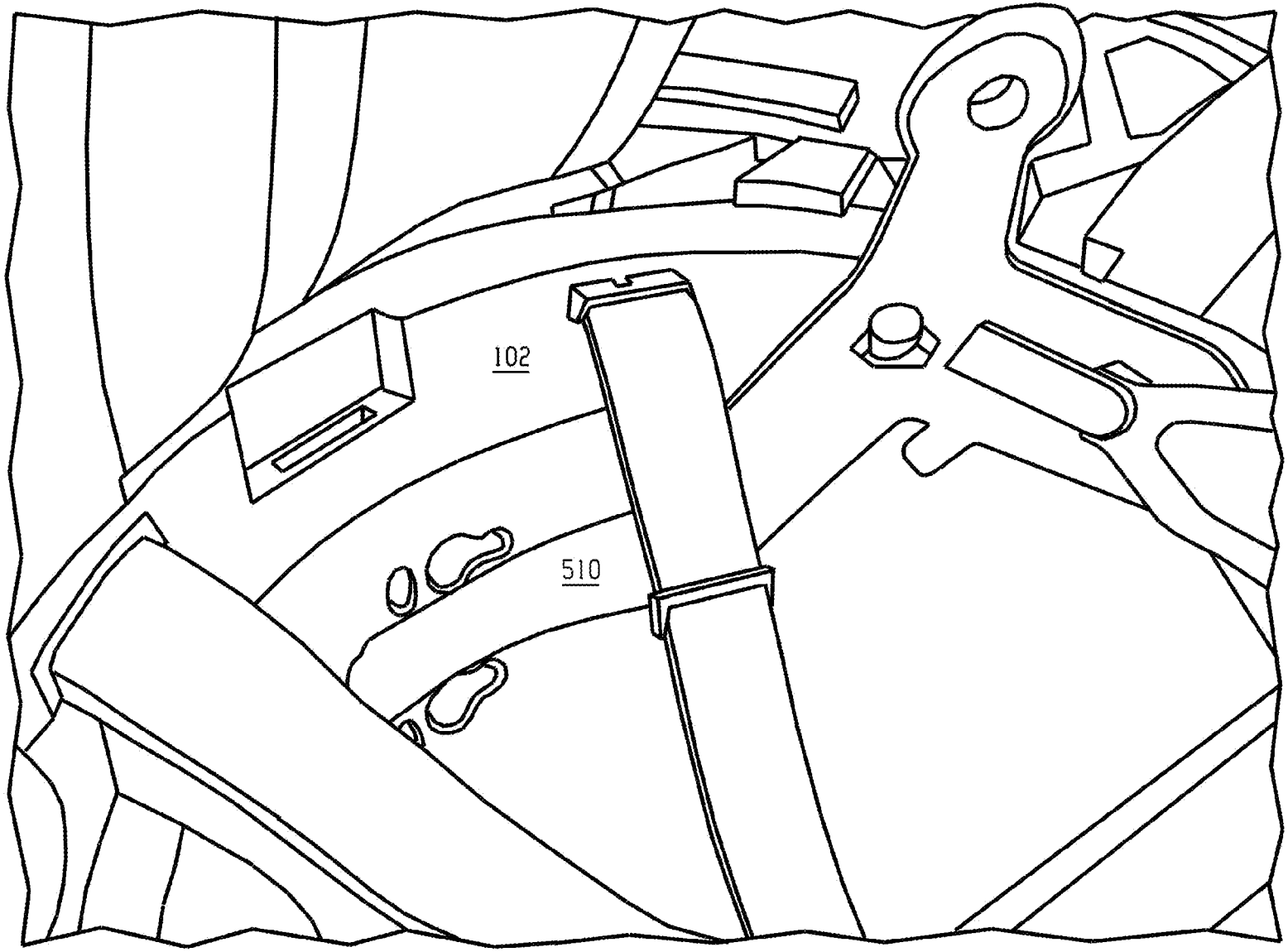
FIGS. 8 and 9 are diagrams depicting a left and a right branch, respectively, of a headband assembly connected to middle headband attachment points of a helmet liner.
Figure 9:
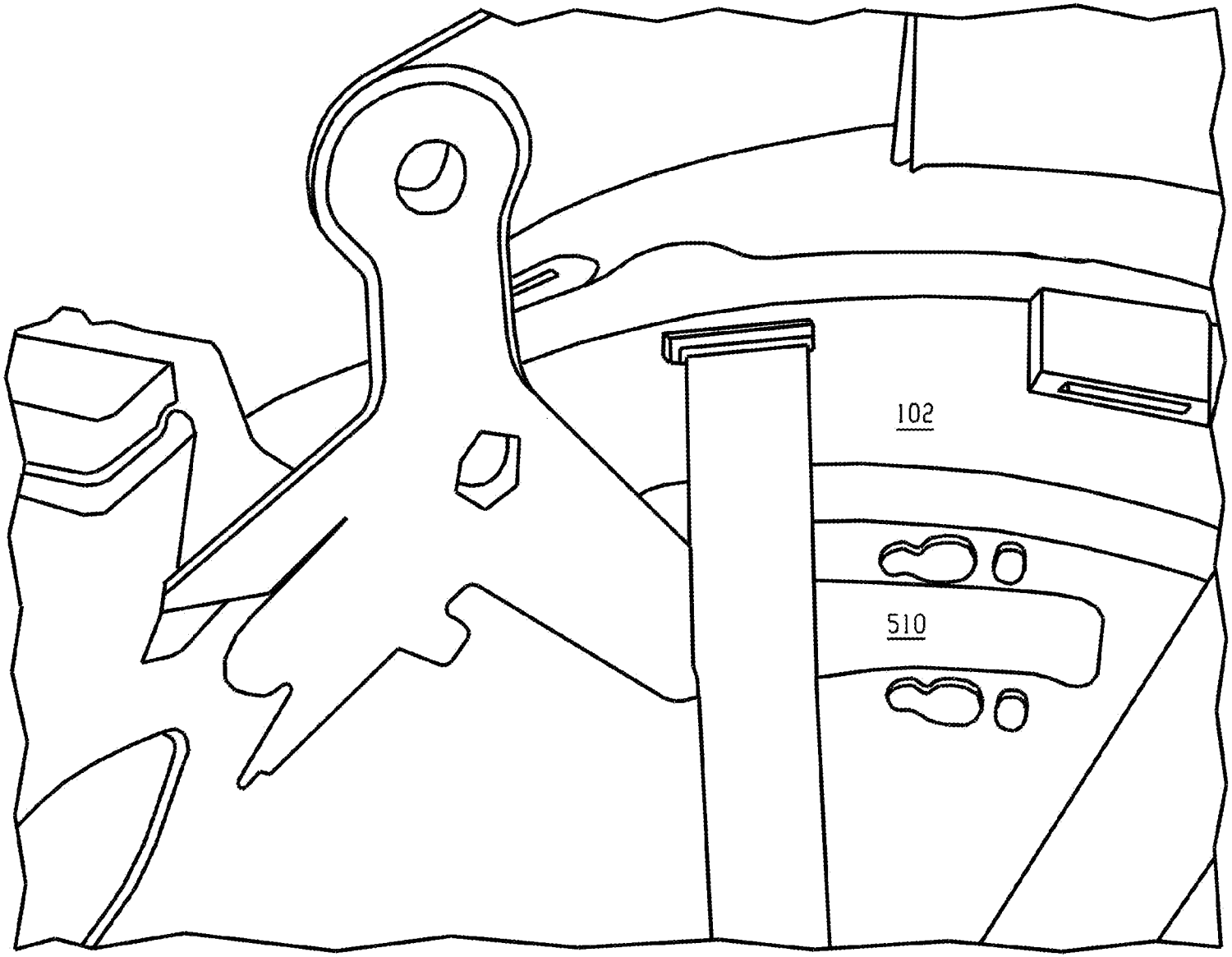
Figure 10:
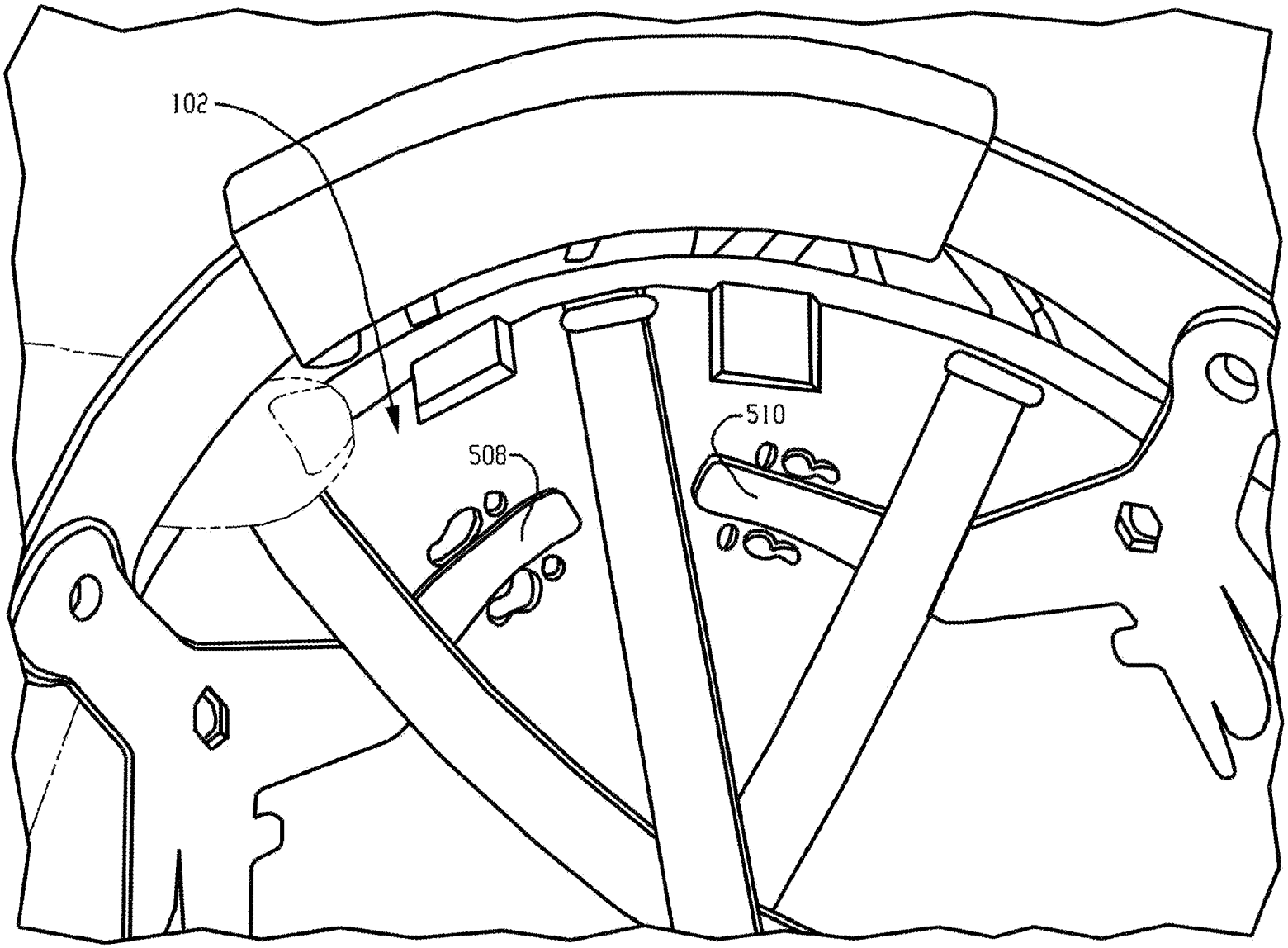
FIG. 10 is a diagram depicting both branches 508, 510 installed into the middle pair of headband attachment points.

FIGS. 8 and 9 are diagrams depicting a left 508 and a right branch 510, respectively, of a headband assembly connected to middle headband attachment points of a helmet liner 102. FIG. 10 is a diagram depicting both branches 508, 510 installed into the middle pair of headband attachment points of a helmet liner 102.

Figure 11:
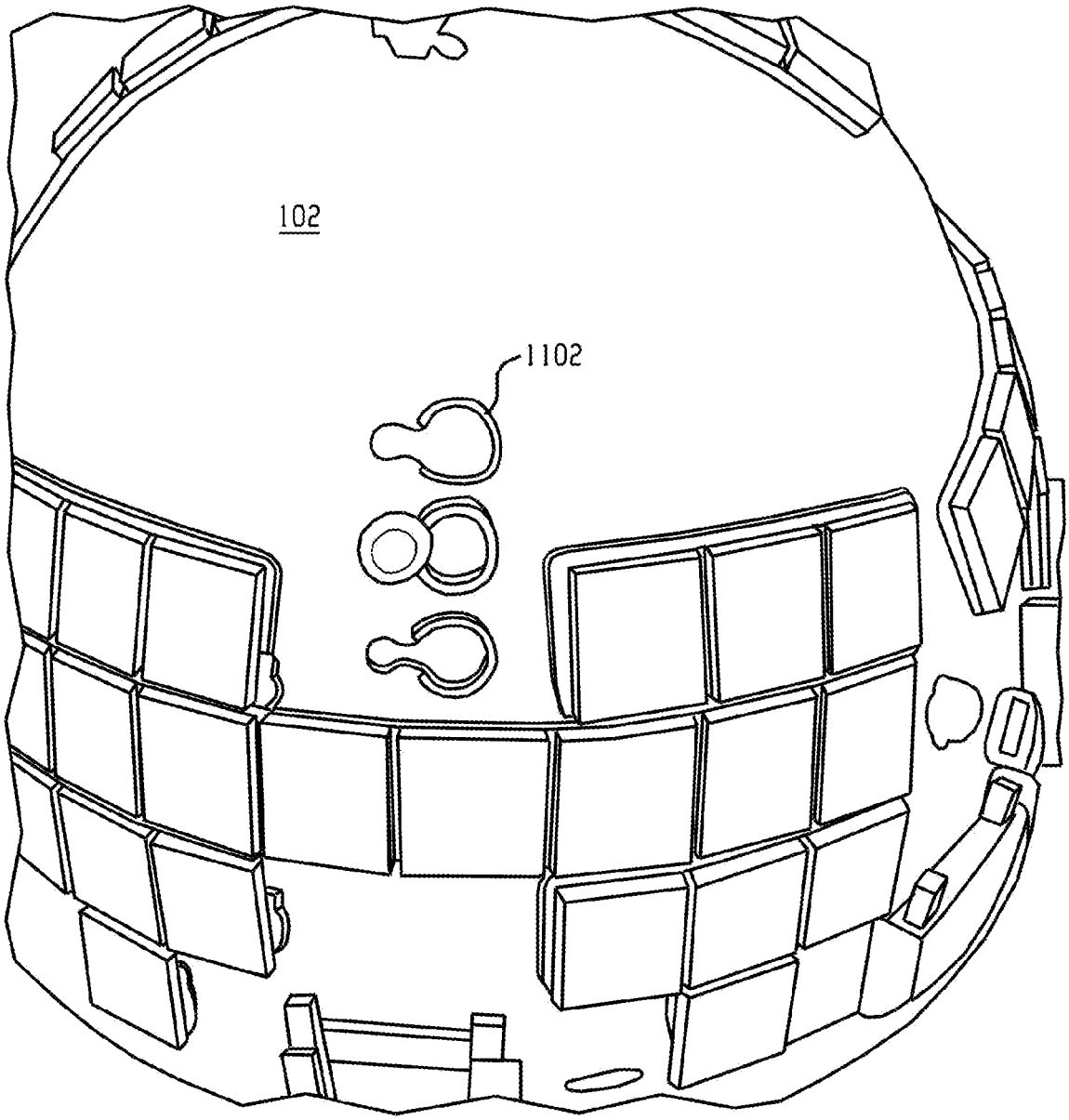
FIG. 11 is a diagram depicting a single opening attachment point.

FIG. 11 is a diagram depicting a single opening headband attachment point. The example headband attachment points herein above largely depict headband attachment points having two openings. In some embodiments, a headband attachment point, for attaching a headband assembly or other structure from the underside or outside of the helmet liner 102 may include only a single opening. FIG. 11 depicts a set of three single opening headband attachment points for adjustably receiving a primary attachment structure (i.e., without a second opening). The single opening 1102 of each adjustment point comprises a first portion large enough for passage of the top of an attachment structure (e.g., a nail shaped attachment structure), and a second portion that is smaller than the top of the attachment structure and larger than the base, where the single opening 1102 is configured to allow shifting of the attachment structure from the first portion to the second portion. In embodiments, an attachment structure may be connected to one or more of the three depicted headband attachment points from the inside of the helmet liner 102 to the outside (as depicted in FIG. 11 or from the outside of the helmet liner 102 to the inside.

Figure 12:
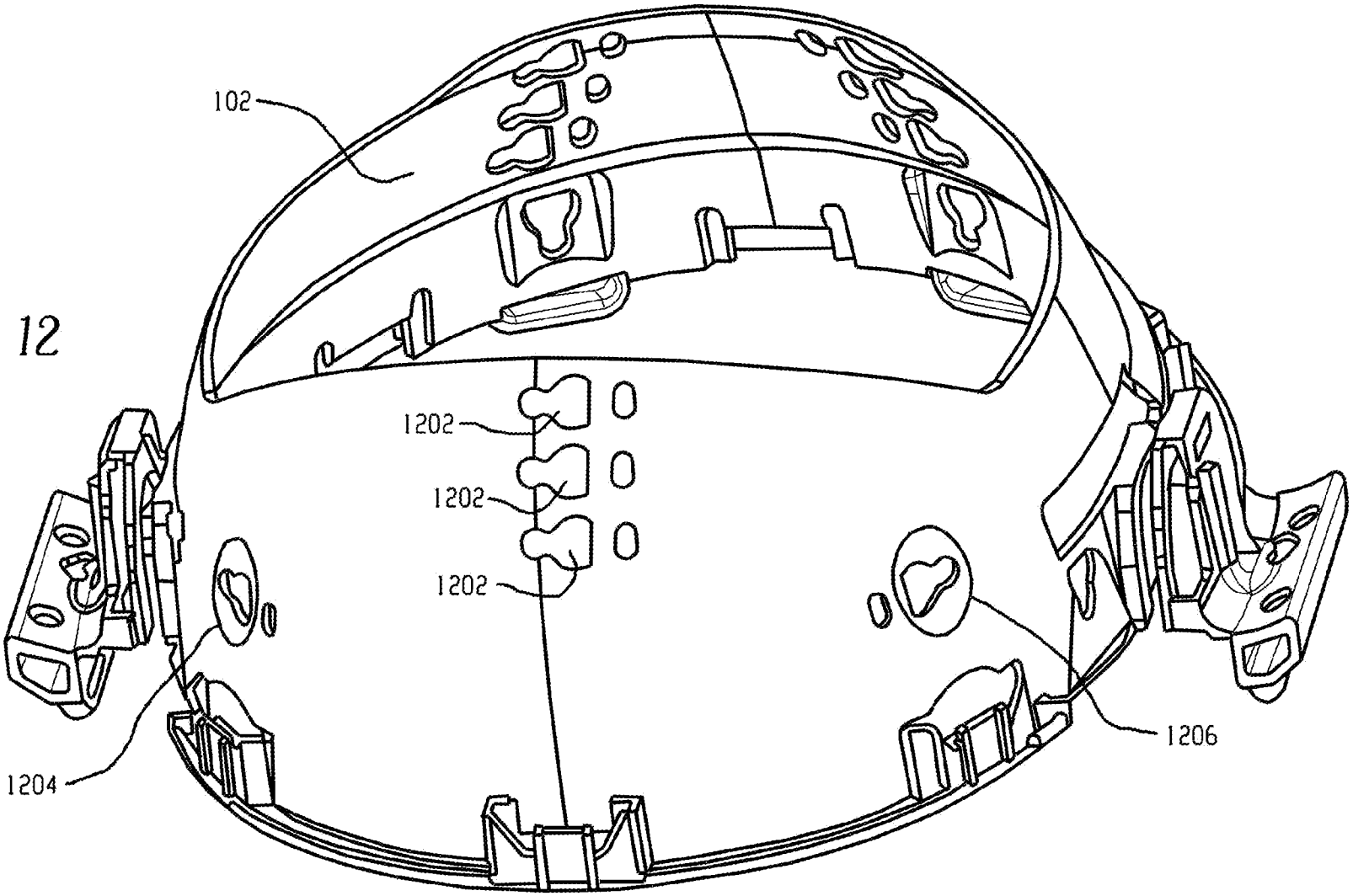
FIG. 12 is a diagram depicting five additional attachment points for connecting a headband assembly or other structure to a helmet liner.

In other embodiments, one or more additional headband attachment points may utilize a multiple (e.g., two or more) opening arrangement. FIG. 12 is a diagram depicting five additional headband attachment points for connecting a headband assembly or other structure to a helmet liner. The helmet liner 102 includes a set of three headband attachment points 1202, which may be configured to provide a structure for adjustably connecting an attachment structure set to the helmet shell (e.g., an attachment structure set that includes a primary attachment structure and a locking pin). FIG. 12 further includes additional headband attachment points 1204, 1206 for further attaching a headband assembly or other structures to the helmet liner 102.

Figure 13:
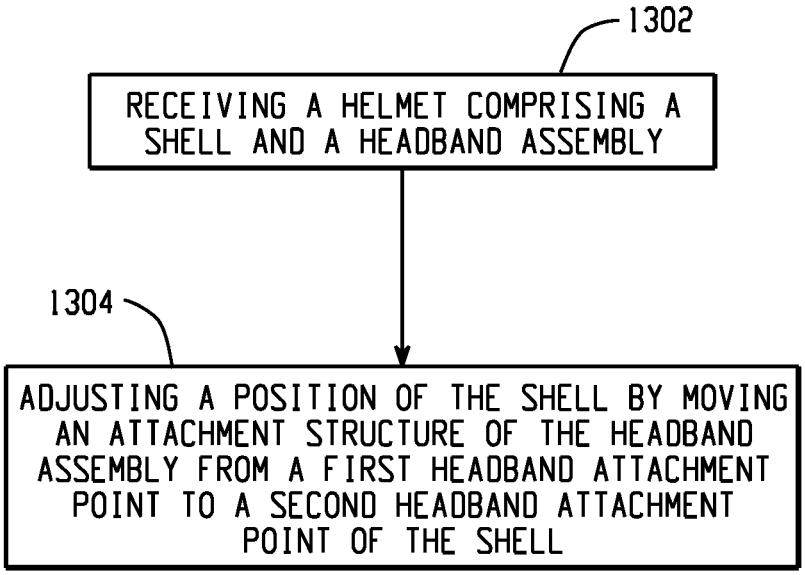
FIG. 13 is a diagram depicting a method of adjusting a helmet.

FIG. 13 is a diagram depicting a method of adjusting a helmet. The method includes receiving a helmet at 1302 that includes: a helmet liner having a plurality of headband attachment points, each headband attachment point comprising a first opening for receiving and holding a primary attachment structure and a second opening for receiving a locking pin; and a headband assembly comprising an attachment structure set comprising a primary attachment structure and a locking pin. A position of a helmet liner is adjusted at 1304 relative to the headband assembly by moving the attachment structure set from a first headband attachment point to a second headband attachment point of the plurality of headband attachment points.

Figure 14:
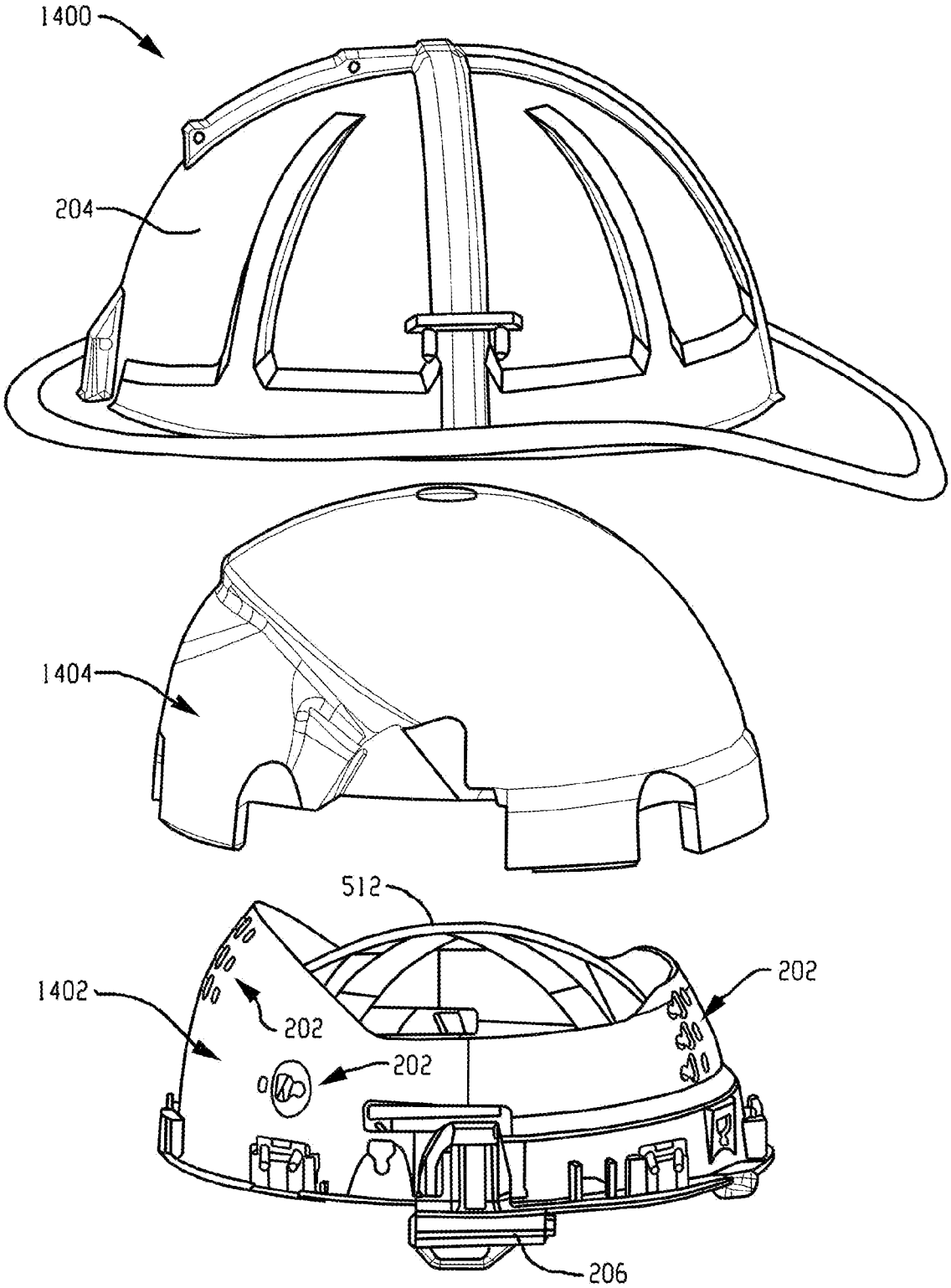
FIG. 14 is a diagram depicting a multi-component helmet liner and an outer shell.

Systems and methods as described herein may take a variety of forms. For example, a helmet liner in certain examples has been described as a single component. In embodiments, a helmet liner may be provided as multiple components. FIG. 14 is a diagram depicting a multi-component helmet liner and an outer shell for mounting on the multi-component helmet liner. The helmet liner includes an inner liner 102 having certain headband and other headband attachment points 202 thereon. The inner liner 102 has an open top, where a suspension web 512 which supports the inner liner 102 on the top of the wearer's head. The helmet liner further includes an intermediate liner 1404. The intermediate liner 1404 may be made of plastic, leather, metal, or other material and may provide cushioning, penetration mitigation, helmet form, and other safety benefits. The helmet further includes an outer shell 204 that is configured to be attached to the helmet liner 102, such as via a sliding lock mechanism 206 once set into position. When attached, the outer shell 204, alone or in combination with the intermediate liner 1404, covers the plurality of headband attachment points 202. In the embodiment of FIG. 14, the outer shell takes the form of a full brimmed fire helmet. As depicted in FIG. 14, a helmet liner may include one or more layers covered by an outer shell. In certain embodiments, the helmet liner, to which a headband assembly may be attached, may be an entirety of the helmet (e.g., the entire helmet is made from a single layer, such as a contiguous piece of material such as molded or 3-D printed plastic).

Figure 15:
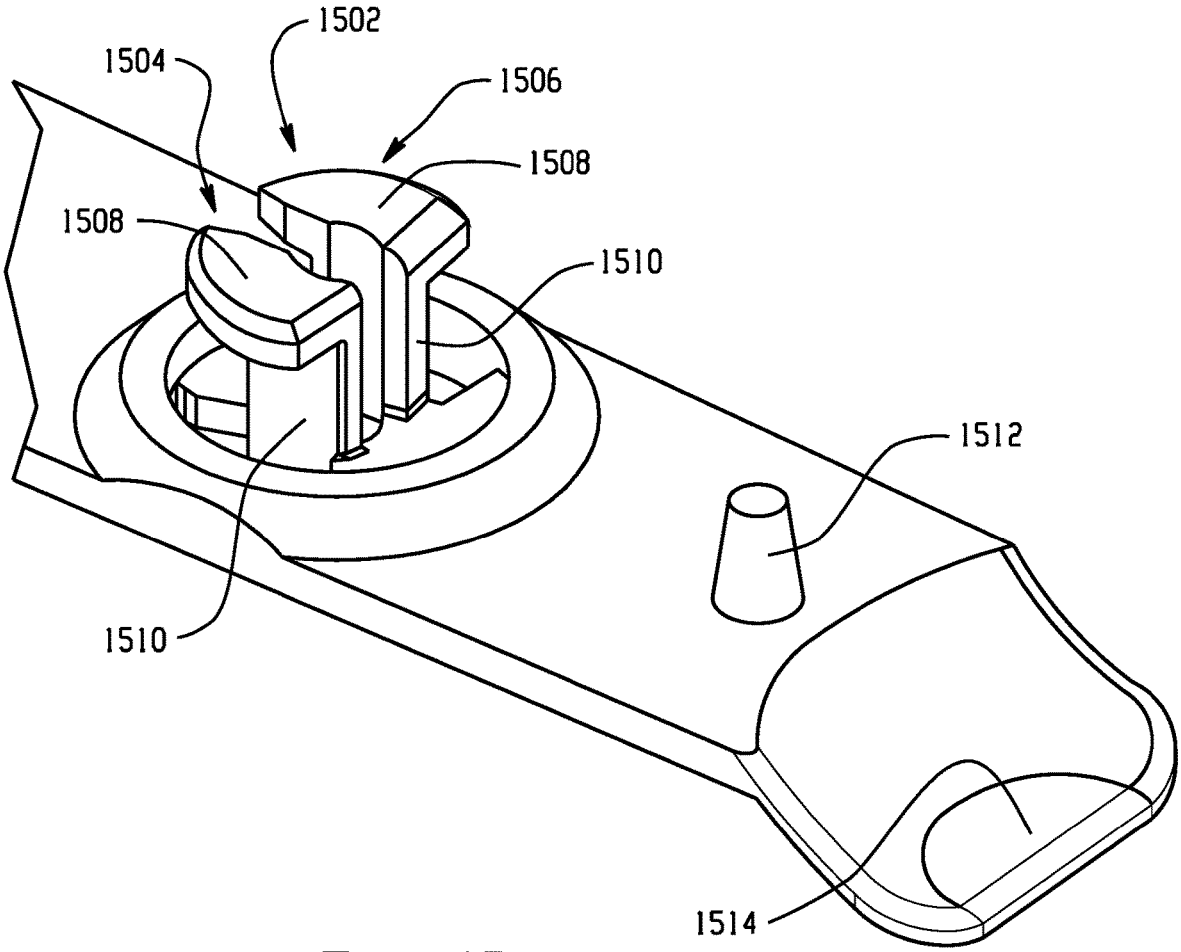
FIGS. 15 and 16 provide alternate configurations of a branch of a headband assembly having a primary attachment structure and a locking pin.
Figure 16:
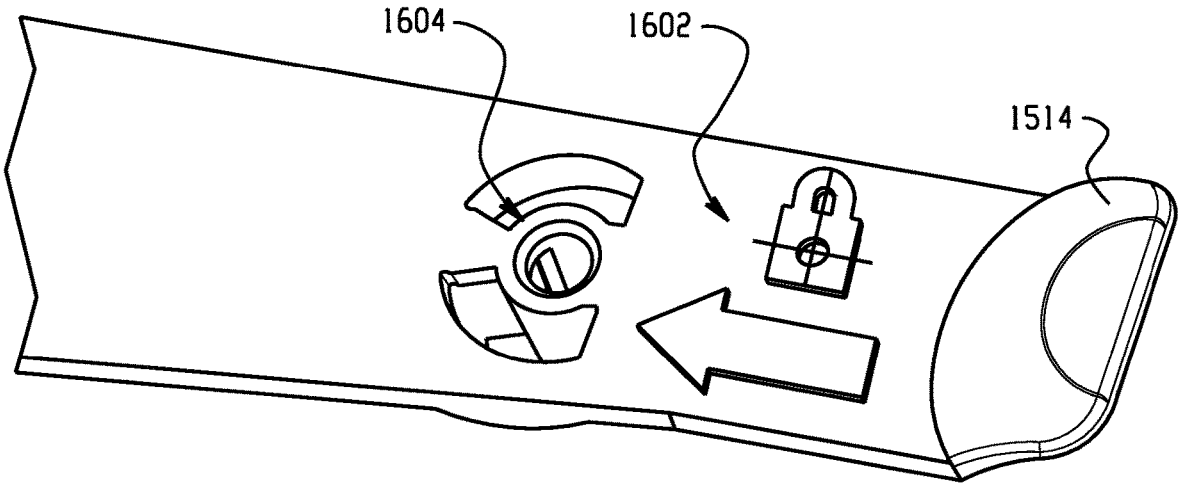

FIGS. 15 and 16 provide alternate configurations of a branch of a headband assembly having a primary attachment structure and a locking pin. FIG. 15 depicts a primary attachment structure 1502 that is formed in two parts 1504, 1506. Each of the two parts include a top sub-portion 1508, which together form a top of the primary attachment structure. Those top sub-portions 1508 are supported by base sub-portions that collectively form a base of the primary attachment structure. The collective size of the two-part top may be manually adjusted by squeezing of the two top sub-portions 1508 together, such that the two top sub-portions 1508 can traverse a smaller opening when squeezed together. The base sub-portions may have elasticity that applies a force to return the top sub-portions 1508 to their depicted state when not being squeezed or otherwise held. The two-part primary attachment structure of FIG. 15 may enable a primary attachment structure to be inserted into and retained within a first opening of a headband attachment point of a smaller size. In embodiments, the first opening of a headband assembly point may only have one portion (e.g., a single, round, oval, square, or rectangular portion), rather than two portions as depicted in other examples herein. The example of FIG. 15 further discloses a locking pin 1512 for insertion into and retention in a second opening of a headband attachment point. The branch may include a tab 1514 that is configured to aid a user in sliding the primary attachment portion 1502 into a correct portion of a first opening and for inserting the locking pin 1512 into a second opening.

FIG. 16 illustrates a reverse side of the headband assembly branch. The reverse side includes an indicator 1602 that illustrates to a user a correct direction to slide the branch and the primary attachment structure thereon to achieve a lock state. This may benefit an installing user who is only able to see an underside of the branch during installation (e.g., during installation onto a helmet liner having an outer shell already attached thereto. Tab 1514 provides a grip point for assisting with installation and removal of the branch from an inner liner. The reverse side 1604 further includes an opening into which other structures (e.g., accessory connection mechanisms) may be inserted and retained.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

It is claimed:

1. A helmet having a configurable headband assembly, comprising:

a headband assembly configured to assist in fitting the helmet to a wearer's head, the headband assembly comprising:

a fit adjustment mechanism configured to adjust an internal shape of the headband assembly; and a plurality of pairs of attachment structure sets, each attachment structure set comprising:

a primary attachment structure; and a locking pin; and a helmet liner having a plurality of pairs of headband attachment points, wherein one headband attachment points in a first pair of headband attachment points comprises:

a first opening for receiving and holding the primary attachment structure of one of the attachment structure sets in a first pair of attachment structure sets in the plurality of pairs of attachment structure sets; and a second opening for receiving the locking pin of the same attachment structure set, and wherein the other headband attachment point in the first pair of headband attachment points comprises:

a first opening for receiving and holding the primary attachment structure of the other attachment structure set in the first pair of attachment structure sets; and a second opening for receiving the locking pin of the same other attachment structure set.

2. The helmet of claim 1, wherein each of the primary attachment structures comprise a base and a top, wherein the top is wider than the base.

3. The helmet of claim 2, wherein each of the first openings comprise a first portion large enough for passage of a top of one of the primary attachment structures and a second portion that is smaller than the top and larger than the base, wherein the first opening is configured to allow shifting of the primary attachment structure from the first portion to the second portion.

4. The helmet of claim 1, wherein each second opening is a slot, wherein the slot is configured to allow movement of the locking pin within the slot; and wherein each first opening is configured to allow rotation of the primary attachment structure inserted therein during movement of the locking pin in same attachment structure set as the primary attachment structure within the slot.

5. The helmet of claim 1, wherein the plurality of pairs of headband attachment points further comprises a second pair of headband attachment points, wherein the headband assembly is configured to be attached to exactly one of the first pair and the second pair at one time.

6. The helmet of claim 5, wherein the second pair of headband attachment points is provided above the first pair of headband attachment points such that selection of one of the pairs of headband attachment points is configured to alter a position of the helmet liner relative to a nape of a neck of the wearer.

7. The helmet of claim 1, wherein the helmet liner further comprises an additional headband attachment point comprising an opening for receiving a primary attachment structure, and wherein the additional headband attachment point does not include a second opening.

8. The helmet of claim 1, wherein the headband assembly comprises a lower circuit for interfacing at least in part with the head of the wearer; and a plurality of branches extending from the lower circuit.

9. The helmet of claim 8, wherein a first branch comprises one of the primary attachment structures and one of the locking pins in one of the attachment structure sets in one of the pairs of attachment structure sets in the plurality of pairs of attachment structure sets; and wherein a second branch comprises one of the primary attachment structures and one of the locking pins in the other attachment structure set in the same pair of attachment structure sets in the plurality of pairs of attachment structure sets.

10. The helmet of claim 8, wherein the fit adjustment mechanism comprises a turnable knob configured to ratchet the lower circuit of the headband assembly to a larger or smaller size.

11. The helmet of claim 8, wherein the lower circuit comprises a portion configured to interface with a nape of a neck of the wearer.

12. The helmet of claim 1, further comprising an outer shell configured to be attached to the helmet liner, wherein the outer shell covers the plurality of pairs of headband attachment points when attached to the helmet liner.

13. The helmet of claim 1, further comprising a suspension web, the suspension web comprising a plurality of straps for supporting the helmet liner on the wearer's head.

14. The helmet of claim 1, wherein each of the primary attachment structures comprises a nail head shape.

15. A method of adjusting a helmet, comprising:

receiving a helmet comprising:

a headband assembly comprising a plurality of pairs of attachment structure sets, wherein each attachment structure set comprises a primary attachment structure and a locking pin; and a helmet liner having a plurality of pairs of headband attachment points, wherein one headband attachment points in one of the plurality of pairs of headband attachment points comprises a first opening for receiving and holding the primary attachment structure of one of the attachment structure sets in one of the pairs in the plurality of pairs of attachment structure sets and a second opening for receiving a locking pin of the same attachment structure set; and wherein the other headband attachment point in the pair of headband attachment points comprises a first opening for receiving and holding the primary attachment structure of the other attachment structure set in the pair of attachment structure sets; and a second opening for receiving the locking pin of the same other attachment structure set; and adjusting a position of the helmet liner relative to the headband assembly by moving the pair of attachment structure sets from a first headband attachment point pair to a second headband attachment point pair of the plurality of pairs of headband attachment points.

16. The method of claim 15, wherein each of the primary attachment structures comprises a base and a top, and wherein the adjusting comprises:

removing each of the locking pins from within the second opening of each of the headband attachment points in the pair of headband attachment points to which the headband attachment points are attached;

sliding each of the primary attachment structures to a position within the first opening of each of the headband attachment points that is large enough for a top of each of the primary attachment structures to pass;

removing each of the primary attachment structures from the first opening of each of the headband attachment points;

inserting the top of each of the primary attachment structures into the first opening of each of the second headband attachment points;

sliding each of the primary attachment structures to a portion of the first opening of each of the second headband attachment points that is smaller than the top of each of the primary attachment structures; and inserting each of the locking pins into the second opening of each of the second headband attachment points.

17. The method of claim 15, wherein each of the primary attachment structures comprises a base and a top, wherein the top is wider than the base.

18. The method of claim 15, wherein each of the primary attachment structures comprises a base and a top, and wherein each first opening comprises a first portion large enough for passage of the top and a second portion that is smaller than the top and larger than the base, such that each primary attachment structure can be shifted from the first portion to the second portion.

* * * * *